US005441203A

United States Patent [19]

Swan et al.

[11] Patent Number: 5,441,203

[45] Date of Patent: Aug. 15, 1995

[54] SPRAY NOZZLE HOLDER CONTAINING TWO VALVES FOR FLOW CONTROL

[75] Inventors: Trevor W. B. Swan; John A. B. Castell, both of Cambridgeshire, United Kingdom

[73] Assignee: Lurmark Limited, Cambridge, United Kingdom

[21] Appl. No.: 182,984

[22] Filed: Jan. 19, 1994

[30] Foreign Application Priority Data

Jan. 25, 1993 [GB] United Kingdom ..... 9301371
Jul. 16, 1993 [GB] United Kingdom ..... 9314828

[51] Int. Cl.[6] ..... B05B 1/32

[52] U.S. Cl. ..... 239/574; 239/581.1; 137/614.17

[58] Field of Search ..... 239/533.1, 533.15, 570–571, 239/574, 581.1; 137/614.17, 510

[56] References Cited

U.S. PATENT DOCUMENTS

| | | | |
|---|---|---|---|
| 1,616,335 | 2/1927 | Rochefort | 239/570 X |
| 2,698,731 | 1/1955 | Koehler et al. | 239/581.1 X |
| 3,701,598 | 10/1972 | Katchka | 137/614.17 X |
| 3,822,040 | 7/1974 | Hibbard | 239/533.15 X |
| 3,863,841 | 2/1975 | Berthoud | 239/266 |
| 4,187,872 | 2/1980 | Freeman et al. | 137/614.17 X |
| 4,736,771 | 4/1988 | McCafferty | 137/614.17 |
| 4,846,221 | 7/1989 | Kanemura | 137/614.17 |
| 5,373,868 | 12/1994 | Rodriguez | 137/614.17 |

FOREIGN PATENT DOCUMENTS

| | | | |
|---|---|---|---|
| 2489469 | 3/1982 | France | 239/571 |
| 2522815 | 12/1975 | Germany | 137/614.17 |
| 128576 | 8/1993 | Japan | 137/614.17 |
| 748888 | 5/1956 | United Kingdom | 137/614.17 |
| 2084902 | 4/1982 | United Kingdom . | |
| 2151946 | 5/1985 | United Kingdom . | |
| 0208412 | 1/1987 | United Kingdom . | |

*Primary Examiner*—Andres Kashnikow
*Assistant Examiner*—Lesley D. Morris
*Attorney, Agent, or Firm*—Watson, Cole, Grindle & Watson

[57] ABSTRACT

A spray nozzle holder (1) has an inlet (12) through which liquid to be sprayed is admitted and an outlet (14) for passing liquid to a nozzle tip attached in use to the holder. A check valve (50,51,52) is positioned between the inlet (12) and the outlet (14) for preventing liquid flow when the liquid pressure is below a predetermined level. A further valve (20,23,24,26) is provided to prevent liquid flow to the outlet (14) during removal or maintenance of the check valve (50,51,52).

18 Claims, 5 Drawing Sheets

SPRAY NOZZLE HOLDER CONTAINING TWO VALVES FOR FLOW CONTROL

The present invention relates to a spray nozzle holder.

A spray nozzle holder is connectable to a pipe which is supplied with liquid for irrigation or for spreading fertilizer, or the like, and has a spray nozzle tip. The spray nozzle tip is usually removable so that the tip can be exchanged with a tip having a different spraying pattern according to need. The nozzle holder may have a check valve, often in the form of a diaphragm check valve, which only allows liquid flow to the nozzle tip when the liquid pressure is above a predetermined level, which prevents the liquid dribbling through the nozzle tip when the supply is nominally turned off.

In use, the check valve can become clogged or worn and so need maintenance or replacing. The user should turn off the liquid supply to the nozzle holder. In practice, however, the user may forget to turn off the liquid supply. In any event, liquid remains in the system even if the supply is turned off because the liquid pressure is not sufficient to overcome the check valve. Thus, even with the liquid supply turned off, liquid inevitably is released when the check valve is released for maintenance. Some of the liquids used can be harmful when in direct contact with skin and, in any event, it is desirable to prevent waste and to prevent any excess spoiling the land.

Accordingly, there is a need to prevent liquid flow during removal or maintenance of the check valve.

According to a first aspect of the present invention, there is provided a spray nozzle holder comprising:

an inlet through which liquid to be sprayed is admitted;

an outlet for passing liquid to a nozzle tip attached in use to the holder;

a check valve between said inlet and said outlet for preventing liquid flow when the liquid pressure is below a predetermined level; and, a further valve for preventing liquid flow to said outlet during removal or maintenance of the check valve.

According to a second aspect of the present invention, there is provided a valve assembly comprising:

a body;

said body having an inlet through which liquid is admitted and an outlet through which liquid exits;

a check valve between said inlet and said outlet for preventing liquid flow when the liquid pressure is below a predetermined level;

a further valve for preventing liquid flow to said outlet during removal or maintenance of the check valve;

a cap which is rotatably fixed to the body and which covers the check valve;

the arrangement being such that the cap can only be removed when rotated to a particular orientation, at which orientation liquid flow to the outlet is prevented.

In each aspect of the invention, a relatively "foolproof" system is provided in which liquid flow is prevented whenever the check valve is accessed.

Preferably, the further valve is upstream of the check valve.

The holder may have a body and a cap which is rotatably fixed to the body and which covers the check valve. The arrangement is preferably such that the cap can only be removed when rotated to a particular orientation, at which orientation liquid flow to the outlet is prevented. Where the further valve is upstream of the check valve, liquid flow to the check valve is prevented when the cap is at the orientation which permits removal. Rotation of the cap away from said orientation is required to allow liquid flow to the outlet and, away from said orientation, the arrangement is such that the cap cannot be removed.

The holder may comprise a barrel which is rotatably mounted within the body, the barrel having an inlet which receives liquid from the holder inlet and an outlet through which liquid passes to the holder outlet, the check valve being situated between the barrel inlet and outlet, the barrel inlet being connected to the holder inlet only when the cap is in the predetermined orientation.

An example of the present invention will be described with reference to the accompanying drawings, in which:

FIG. 2 is a longitudinal cross-sectional view on an enlarged scale of the nozzle holder with the cap engaged and the valve on;

Figure 1:
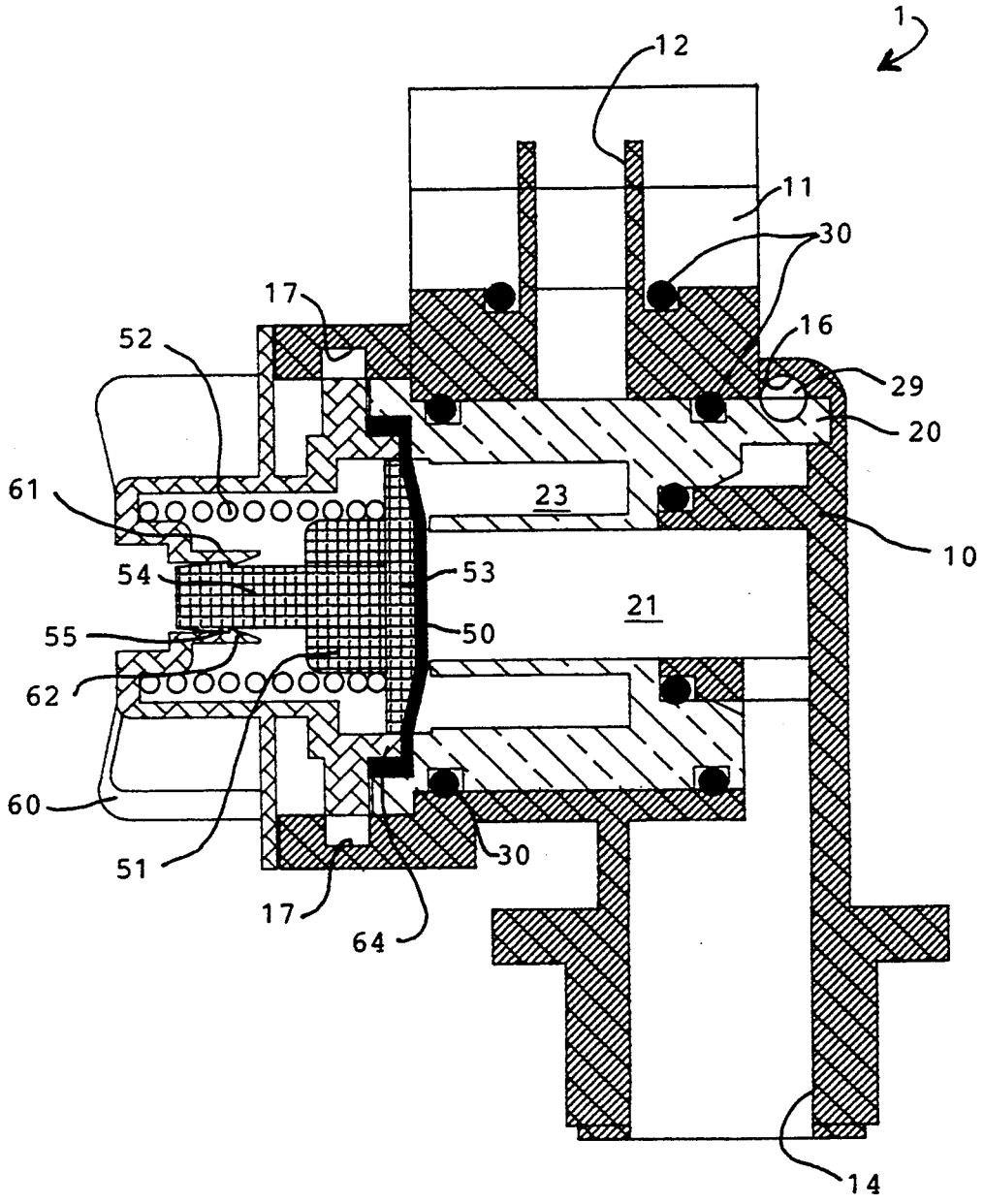
FIG. 1 is a longitudinal cross-sectional view on an enlarged scale of a nozzle holder with a cap engaged and the valve off.
Figure 2:
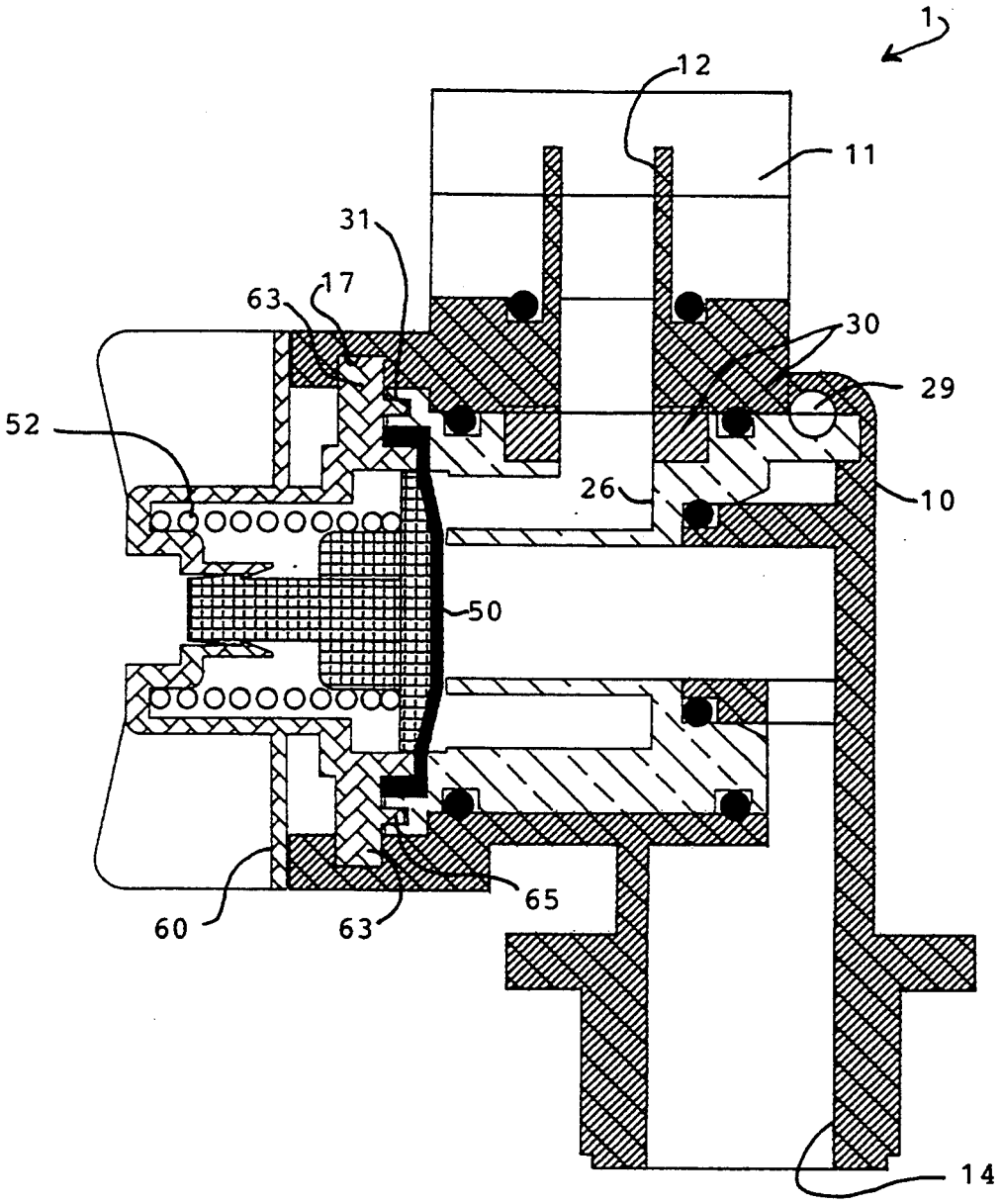

The components shown in FIGS. 3 to 12 represent preferred variations of the components used in the holder shown in FIGS. 1 and 2.

A spray nozzle holder 1 generally comprises a body 10, a barrel 20, and a cap 60. The cap 60 contains a diaphragm check valve which consists of a diaphragm 50 maintained in place by a pressure disk 51 under the action of a coiled compression spring 52 which acts between the pressure disk 51 and the cap 60.

As shown in FIGS. 1 to 4, the body 10 has external flanges 11 which enable the holder 1 to be fixed to a supply pipe (not shown) which carries the liquid to be sprayed, such as water for irrigation or a solution of pesticide, fertilizer, or other material. The body 10 has an inlet 12 through which liquid passes from the supply pipe ultimately to the nozzle tip (not shown) from where it is sprayed. The inlet 12 is positioned between the flanges 11 as is conventional.

The inlet 12 opens to a central chamber 13 which contains the barrel 20, to be described in detail later, and which opens to an outlet 14 ultimately to the nozzle tip. The chamber 13 is of circular cross section. A nozzle tip can be fixed into the outlet 14, using a bayonet-type fitting 15 (FIGS. 3 to 5), for example. A screw thread fitting can alternatively be used, for example.

As shown in FIGS. 1 and 6 to 8, the barrel 20 is generally cylindrical having a circular cross-section, the outer diameter of which is sized so that the barrel 20 can be received in the chamber 13 as a sliding fit and can rotate about its central longitudinal axis in the chamber 13.

The barrel 20 is generally hollow and has a central chamber 21 which is surrounded by an annular wall 22, the annular wall 22 defining a further, annular chamber 23 between the annular wall 22 and the outer wall 24 of the barrel 20. The barrel 20 has a mouth 25, the diameter of which is greater than that of the annular chamber 23, the annular wall 22 stopping just short of the relatively wide mouth 25 as shown particularly in FIGS. 1 and 6.

The annular chamber 23 in the barrel 20 has an opening 26 to the outer, side wall 24. The inlet 26 to the annular chamber 23 is aligned with the inlet 12 to the body 10 only when the barrel 20 is at a particular predetermined orientation in the body 10, as will be described in more detail below.

The barrel 20 has a grooved recess 27 in a rear arcuate flange 28. A similar grooved recess 16 is provided at the corresponding position internally of the body 10. The recesses 16, 27 receive a locking pin 29 which retains the barrel 20 in the body 10. A number of sealing gaskets and O-rings 30 are provided between the barrel 20 and the body 10 and around the body inlet 12.

The diaphragm 50 of the diaphragm check valve is pressed into the mouth 25 of the barrel 20 and the central portion of the diaphragm 50 is pressed against the end walls of the inner annular wall 22 by the pressure disk 51. The pressure disk 51 has a domed head 53 and a stem 54, the stem 54 having an outwardly flared collar 55 at the end remote from the head 53. The pressure disk 51 is urged against the diaphragm 50 by the coil spring 52 which presses the central region of the diaphragm 50 against the end wall of the inner annular wall 22 of the barrel 20, thereby sealing the inner chamber 21 from the outer chamber 23 of the barrel 20. This prevents liquid flow between the inner chamber 21 and outer chamber 23 until the pressure of liquid in the outer chamber 23 is sufficient to overcome the force supplied by the spring 52.

The pressure disk 51 and coil spring 52 are retained against the diaphragm 50 by the cap 60. As shown in FIGS. 1 and 9 to 12, the cap 60 is generally cylindrical and has an in-turned collar 61 provided in a central recess. The collar 61 has an inwardly flared portion 62 at its innermost end which corresponds to the outwardly flared collar 55 on the pressure disk 51.

To assemble the diaphragm check valve, the coil spring 52 is placed around the collar 61 of the cap 60 and the stem 54 of the pressure disk 51 is pressed through the collar 61 of the cap 60, causing the respective flares 55, 62 on the pressure disk 51 and cap 60 to ride over each other. The respective flares 55, 62 prevent the pressure disk 51 from being withdrawn to the right in FIG. 1, trapping the spring 52 between the cap 60 and the domed head 53 of the pressure disk 51.

The cap 60 has two diametrically-opposed lugs 63 which pass into respective circumferential slots 17 provided in the outer wall of the body 10 adjacent the main opening 18 to the chamber 13. The slots 17 have entry apertures 19 through which the lugs 63 may pass to enter the slots 17, the cap 60 being turned after the lugs 63 have entered the slots 17. This bayonet-type engagement between the lugs 63 and the slots 17 serves to keep the cap 60 on the body 10. Note that the cap 60 can only be positioned on and removed from the body 10 when the lugs 63 are in a predetermined relative angular orientation, which is defined by the relative position of the entry apertures 19. In the example of the body 10 and cap 60 shown in FIGS. 6 to 12, as the lugs 63 can be seen through the slots 17, a visual indication of the angular position of the cap 60 is provided; this may be enhanced by icons 66 on the exterior of the body 10 indicating when the valve is "ON" or "OFF".

Note that the cross-sectional views FIG. 1 and FIG. 2 are not strictly accurate in that the lugs 63 are shown in FIG. 2 as being in line with a line joining the inlet 12 and outlet 14 for a clearer understanding of the invention, whereas, as can be seen in FIGS. 9 to 12 for example, the lugs 63 are actually off-axis.

The cap 60 has an annular wall 64 which is received in the mouth of the barrel 20, trapping the diaphragm 50 between the cap 60 and the barrel 20. The cap 60 further has a short blade 65 adjacent each lug 63, radially outwards of the annular wall 64, and extending parallel to the longitudinal axis of the cap 60. The blades 65 extend into respective recesses 31 in the barrel 20, the recesses 31 being sized to receive the blades 65 in a close fit. Accordingly, rotation of the cap 60 carries the barrel 20, thus enabling the barrel 20 to be rotated back and forth between the supply "ON" position, at which the inlet 26 of the barrel is aligned with the inlet 12 of the body 10, and supply "OFF" position, at which the barrel inlet 26 is out of alignment with the body inlet 12. The rotation stop positions of the barrel 20 are defined by abutment between the ends of the arcuate flange 28 on the barrel 20 with the ends of an arcuate groove 32 in the body 10. In the embodiment illustrated herein, the barrel 20 and the cap 60 are fixed against rotation with respect to each other so that rotation of the cap 60 and barrel 20 carries the diaphragm to prevent twisting thereof.

Flow control is achieved in this example because the angular displacement between the cap 60 and the barrel 20 is fixed (by the blades 65 engaging in the recesses 31), and the cap 60 can only be fitted to the body 10 by passing the lugs 63 through the entry apertures 19 to the slots 17, meaning that whenever the cap 60 is to be removed, it must be rotated back to a particular orientation. The barrel 20 is constructed so that, at this orientation, the barrel 20 is at its first rotation stop, which takes the inlets 26, 12 out of alignment. Thus, whenever the cap 16 is removed, liquid flow to the outlet is necessarily cut off. In the example shown, as the further valve provided by this cutoff is upstream of the diaphragm check valve, whenever the diaphragm check valve is removed, liquid flow beyond the body inlet 12 is necessarily prevented.

The body 10 has two diametrically-opposed sets of three small recesses 33 in the wall adjacent the mouth 18 of the body 10. The barrel 20 has a pair of corresponding diametrically-opposed projecting nibs 34 on the outermost wall adjacent the mouth 25 of the barrel 20. The nibs 34 are received by a respective one of the three recesses 33 according to whether the valve is "ON" "OFF", or able to be removed, providing the user with a "click" as the nibs 34 move from one detent position to another in the recesses 33.

The cap 60 shown in FIGS. 9 to 12 has an integrally moulded arrow 67, the diametrically-opposite tips 68 of which extend radially over the periphery of the cap 60.

Figure 3:
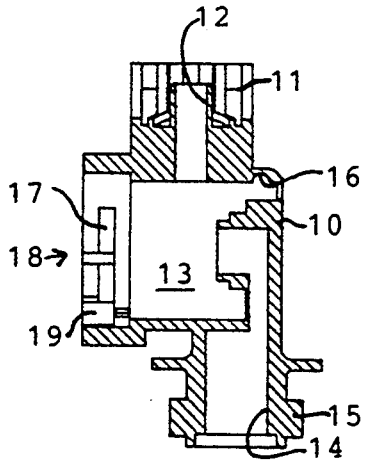
FIG. 3 is a longitudinal cross-sectional view of an example of a body of the holder.
Figure 4:
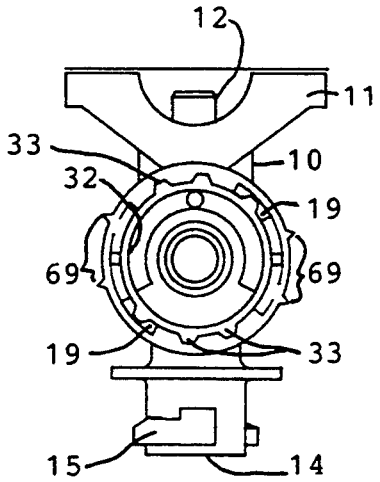
FIG. 4 is a view from the valve end of the body of FIG. 3.
Figure 5:
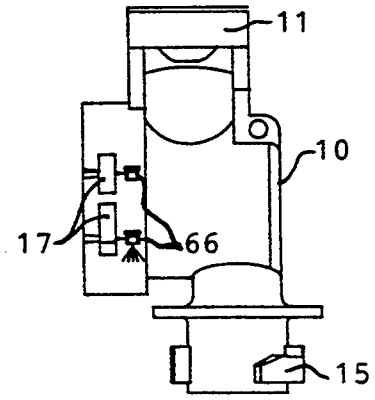
FIG. 5 is an elevation of the body of FIG. 3.
Figure 6:
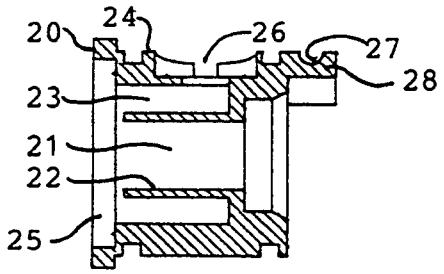
FIG. 6 is a longitudinal cross-sectional view of an example of a barrel of the holder.
Figure 7:
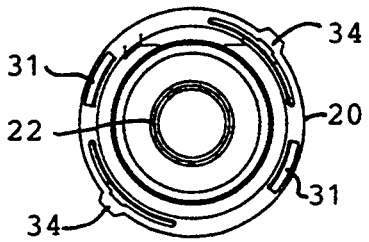
FIG. 7 is a view from the valve end of the barrel of FIG. 6.
Figure 8:
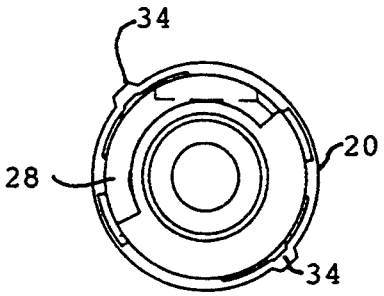
FIG. 8 is a view from the other end of the barrel of FIG. 6.
Figure 9:
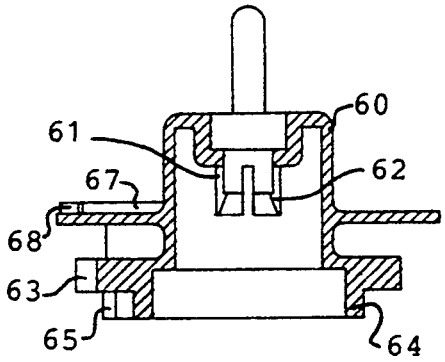
FIG. 9 is a longitudinal cross-sectional view of an example of a cap.
Figure 10:
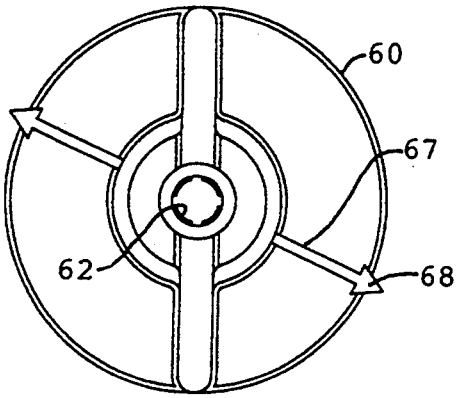
FIG. 10 is an elevation of the cap of FIG. 9.
Figure 11:
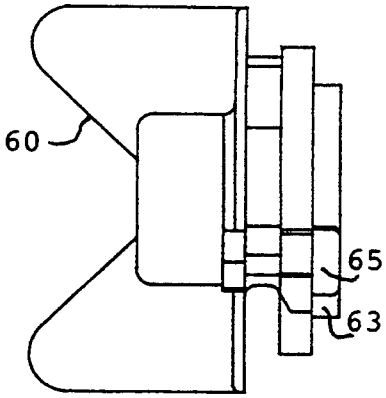
FIG. 11 is a view from the valve end of the cap of FIG. 9.
Figure 12:
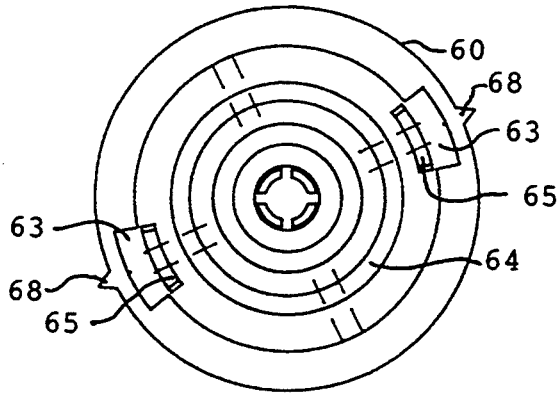
FIG. 12 is a view from the other end of the cap of FIG. 9.

The body 10 shown in FIGS. 3 to 5 has two diametrically-opposed pairs of corresponding nibs 69 which extend outwardly of the main part of the body 10. The radius tips 68 and the body nibs 69 are positioned to be respectively aligned when the valve is either ON or OFF, thus allowing the user to feel whether or not the valve is ON or OFF.

What is claimed is:

1. A spray nozzle holder comprising:

an inlet through which liquid to be sprayed is admitted;

an outlet for passing liquid to a nozzle tip attached in use to the holder;

a removable check valve between said inlet and said outlet for preventing liquid flow when the liquid pressure is below a predetermined level;

a further valve located upstream of the check valve and positionable for preventing liquid flow to said outlet during removal or maintenance of the check valve; and the check valve only being removable when the further valve is positioned to prevent liquid flow beyond the further valve.

2. A holder according to claim 1, wherein the holder has a body and a cap which is rotatably fixed to the body and which covers the check valve.

3. A holder according to claim 2, wherein the arrangement is such that the cap can only be removed when rotated to a particular orientation, at which orientation liquid flow to the outlet is prevented.

4. A holder according to claim 3, comprising a barrel which is rotatably mounted within the body, the barrel having an inlet which receives liquid from the holder inlet and an outlet through which liquid passes to the holder outlet, the check valve being situated between the barrel inlet and outlet, the barrel inlet being connected to the holder inlet only when the cap is in said predetermined orientation.

5. A holder according to claim 1, wherein the check valve is a diaphragm check valve, said diaphragm check valve including a diaphragm biased by biasing means to prevent liquid flow when the liquid pressure is below a predetermined level.

6. A holder according to claim 2, wherein the check valve is a diaphragm check valve, said diaphragm check valve including a diaphragm biased by biasing means to prevent liquid flow when the liquid pressure is below a predetermined level, said check valve including a pressure disk biased by the biasing means against the diaphragm to prevent liquid flow when the liquid pressure is below a predetermined level.

7. A holder according to claim 2, wherein the cap has at least one lug which passes into a respective slot in the body via an entry aperture to retain the cap on the body.

8. A holder according to claim 4, wherein the cap has a blade which is received in a recess in the barrel so that rotation of the cap causes the barrel to rotate.

9. A holder according to claim 4, wherein the check valve is a diaphragm check valve including a diaphragm biased by biasing means to prevent liquid flow when the liquid pressure is below a predetermined level, the diaphragm being trapped between the barrel and the cap, the barrel and the cap being fixed against rotation with respect to each other so that rotation of the cap and barrel carries the diaphragm to prevent twisting of the diaphragm.

10. A valve assembly comprising:

a body;

said body having an inlet through which liquid is admitted and an outlet through which liquid exits;

a check valve between said inlet and said outlet for preventing liquid flow when the liquid pressure is below a predetermined level;

a further valve for preventing liquid-flow to said outlet during removal or maintenance of the check valve;

a cap which is rotatably fixed to the body and which covers the check valve;

the arrangement being such that the cap can only be removed when rotated to a particular orientation, at which orientation liquid flow to the outlet is prevented.

11. An assemblyaccording to claim 10, wherein the further valve is upstream of the check valve.

12. An assembly according to claim 10, comprising a barrel which is rotatably mounted within the body, the barrel having an inlet which receives liquid from said body inlet and an outlet through which liquid passes to the body outlet, the check valve being situated between the barrel inlet and outlet, the barrel inlet being connected to the body inlet only when the cap is in said predetermined orientation.

13. An assembly according to claim 10, wherein the check valve is a diaphragm check valve, said diaphragm check valve including a diaphragm biased by biasing means to prevent liquid flow when the liquid pressure is below a predetermined level.

14. An assembly according to claim 12, wherein the check valve is a diaphragm check valve, said diaphragm check valve including a diaphragm biased by biasing means to prevent liquid flow when the liquid pressure is below a predetermined level, said check valve including a pressure disk biased by the biasing means against the diaphragm to prevent liquid flow when the liquid pressure is below a predetermined level.

15. An assembly according to claim 10, wherein the cap has at least one lug which passes into a respective slot in the body via an entry aperture to retain the cap on the body.

16. An assembly according to claim 10, wherein the cap has a blade which is received in a recess in the barrel so that rotation of the cap causes the barrel to rotate.

17. An assembly according to claim 10, wherein the check valve is a diaphragm check valve, said diaphragm check valve including a diaphragm biased by biasing means to prevent liquid flow when the liquid pressure is below a predetermined level, the diaphragm being trapped between the barrel and the cap, the barrel and the cap being fixed against; rotation with respect to each other so that rotation of the cap and barrel carries the diaphragm to prevent twisting of the diaphragm.

18. A spray nozzle holder comprising:

an inlet through which liquid to be sprayed is admitted;

an outlet for passing liquid to a nozzle tip attached in use to the holder;

a check valve removably mounted between said inlet and said outlet for preventing liquid flow when the liquid pressure is below a predetermined level;

a further valve located between the inlet and the outlet upstream of the check valve; and a cap for releasably securing the check valve in the holder and being operatively coupled to the further valve, said further valve being positionable by the cap for preventing liquid flow to said outlet and the check valve being releasably removable by the cap only when the further valve is positioned to prevent liquid flow to the outlet.

* * * * *